US006270412B1

(12) United States Patent
Crawford et al.

(10) Patent No.: US 6,270,412 B1
(45) **Date of Patent: *Aug. 7, 2001**

(54) SLOT MACHINE WITH SYMBOL SAVE FEATURE

(75) Inventors: Curtis J. Crawford; James P. Jackson, both of Henderson, NV (US)

(73) Assignee: Sigma Game, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/436,088

(22) Filed: Nov. 8, 1999

Related U.S. Application Data

(63) Continuation-in-part of application No. 08/735,908, filed on Oct. 25, 1996, now Pat. No. 5,997,401.

(51) Int. Cl.[7] ..... A63F 9/22; G07F 17/34

(52) U.S. Cl. ..... 463/20; 463/21; 273/143 R

(58) Field of Search ..... 463/1, 11–13, 463/16, 17–20, 21, 25, 30, 40, 36; 273/143 R, 292, 293, 138.1, 138.2, 139

(56) References Cited

U.S. PATENT DOCUMENTS 4,648,600 * 3/1987 Olliges ..... 463/20
5,630,753 * 5/1997 Fuchs ..... 463/12
5,704,835 * 1/1998 Dietz, II ..... 463/20
5,997,401 * 12/1999 Crawford ..... 463/20

FOREIGN PATENT DOCUMENTS 0 609 637A1 * 8/1994 (EP) .
2050 028 * 12/1980 (GB) .
2243 236 * 10/1991 (GB) .

* cited by examiner

*Primary Examiner*—Mark Sager
(74) *Attorney, Agent, or Firm*—Skjerven Morrill MacPherson LLP; Brian D. Ogonowsky

(57) ABSTRACT

A method for operating a rotating reel type slot machine, or a video machine which depicts rotating reels, is described herein which allows a player to save in memory one or more symbols from one or more previous games and use those symbols in a current game to obtain a winning combination. In one embodiment, multiple sets of reels are employed, and saved symbols from a primary sets of reels may be used for any of said multiple sets of reels in subsequent games. In one embodiment, additional coins may be deposited to allow the use of saved symbols with additional reel sets. In another embodiment, a special symbol displayed by a first set of reels causes corresponding reels in second and third sets of reels to stop at the special symbol.

45 Claims, 9 Drawing Sheets

SLOT MACHINE WITH SYMBOL SAVE FEATURE

CROSS-REFERENCE TO RELATED APPLICATIONS

This is a continuation-in-part of U.S. application Ser. No. 08/735,908, filed Oct. 25, 1996,now U.S. Pat. No. 5,997,401 entitled Slot Machine With A Symbol Save Feature, by Curtis J. Crawford.

FIELD OF THE INVENTION

This invention relates to slot machines and, in particular, to an additional playing feature for a slot machine.

BACKGROUND OF THE INVENTION

FIG. 1 illustrates the well known basic circuitry of a modern slot machine 10 which incorporates rotating reels. In such a slot machine 10, each of the reels 12, 13, and 14 has a variety of symbols printed on its periphery. Each of the reels 12–14 is driven by a separate stepper motor 16 which rotates in response to pulses from a CPU 18. When the pulses to a stepper motor 16 are terminated, the reel stops abruptly.

In modern slot machines, the stopping positions of the reels 12–14 are predetermined using a random number generator consisting of a random number generator program in the program ROM 20 carried out by the CPU 18. The required number of pulses to the three stepper motors are then generated to display the symbol combination at the predetermined reel positions.

In one common type of slot machine, the number of pulses after the reel has reached a zero position are counted to determine the final position of the reels. In another type of machine, each of the reels has tabs that are sensed by a photodetector to determine the angular displacement of the reel and thus the final displayed symbol. Other means for detecting the positions of the reels exist and are well known.

A money detector 22, which may detect coins or other currency, issues a command to the CPU 18 that the slot machine 10 is ready to be played. The player may then pull a handle 24 or press a button to initiate play.

After the reels have stopped, and the CPU 18 determines the final stop positions, the stop positions are then applied to a pay-table ROM 26, which cross-references the final displayed symbols with a monetary payout to the player. This payout is then conveyed to a payout mechanism 28 which issues coins or credits to the player. A display 30 may also be activated, signaling a win to the player.

The above general description of a modern slot machine would be well known in the art, and such a programmable machine offers great advantages. Slot machines are varied by simply changing the operating program in the program ROM 20 and the award program in the pay-table ROM 26. The front glass of the slot machine is also changeable to convey particular features of the machine.

Additional detail of such conventional slot machines is found in U.S. Pat. No. 4,095,795 to Saxton et al.; U.S. Pat. No. 4,448,419 to Telnaes; and U.S. Pat. No. 4,573,681 to Okada, all incorporated herein by reference.

One well known award criterion for a 3-reel slot machine is the matching of symbols in a horizontal direction. After each game, the player again pulls the handle so that each game is completely independent of all previous games.

Although the slot machine of FIG. 1 is very successful, even more player appeal would be created by allowing the player additional possibilities for winning.

SUMMARY

A method for operating a rotating reel type slot machine, or a video machine which depicts rotating reels, is described herein which allows a player to save in memory one or more symbols from one or more previous games and use those symbols in a current game to obtain a winning combination. The invention may be implemented by relatively minor changes in the software code in the program ROM and the pay-table ROM of a conventional slot machine.

The display glass of the slot machine contains an area for displaying the saved symbols. If a video slot machine is used to implement the invention, the video screen may display the saved symbols.

In another embodiment, special symbols, such as winning symbols, are saved automatically by the machine. This concept can be extended to a slot machine having multiple sets of reels, where a winning symbol displayed by a primary set of reels causes the corresponding reel in one or more secondary sets of reels to stop on the same special symbol.

DETAILED DESCRIPTION OF THE PREFERRED EMBODIMENTS

Figure 2:
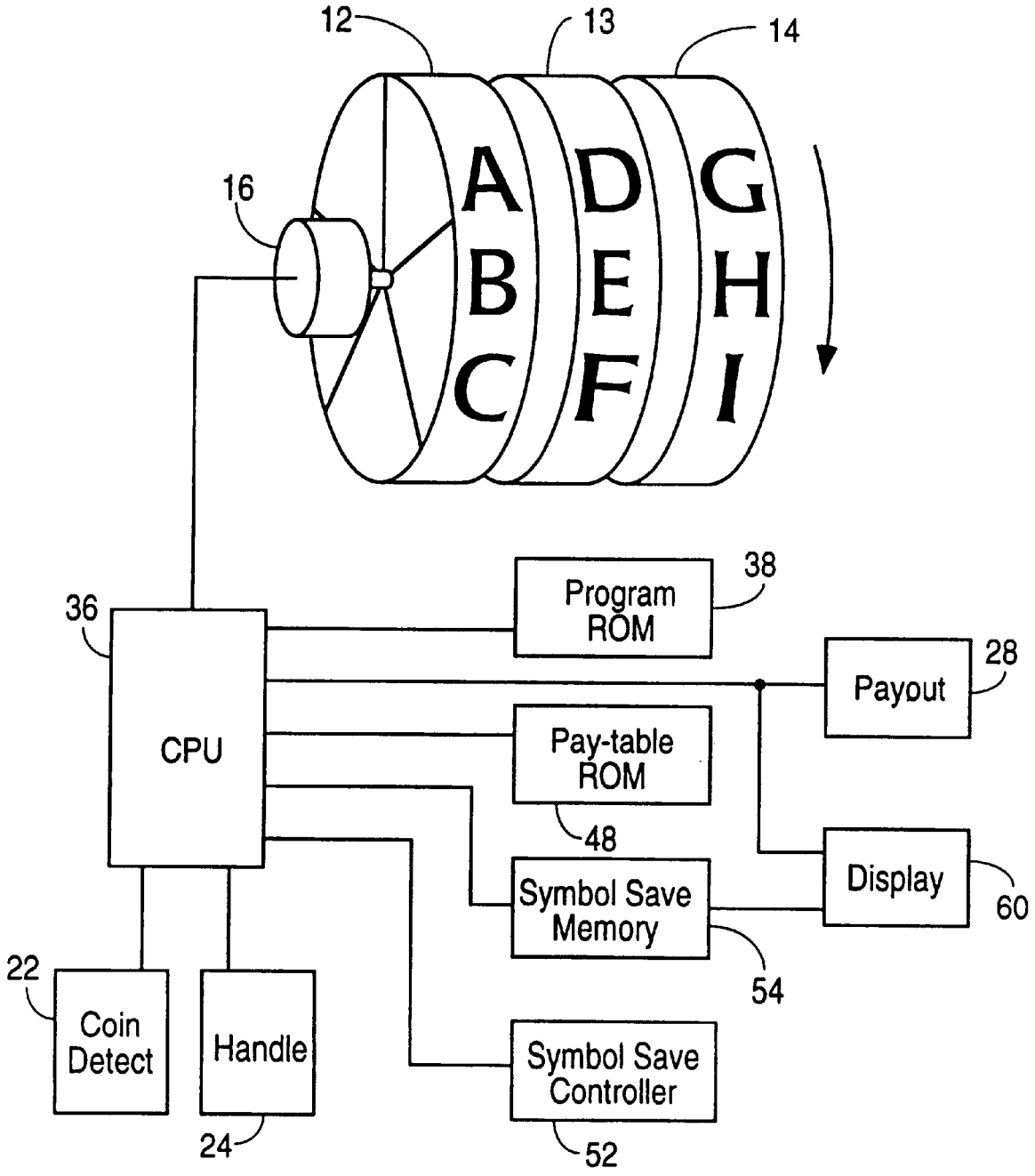
FIG. 2 illustrates the circuitry of FIG. 1, but augmented to incorporate the present invention.

FIG. 2 illustrates the circuitry used in a slot machine in accordance with the present invention. Elements identified with the same numerals in the various figures may be identical and will not be redundantly described.

Figure 1:
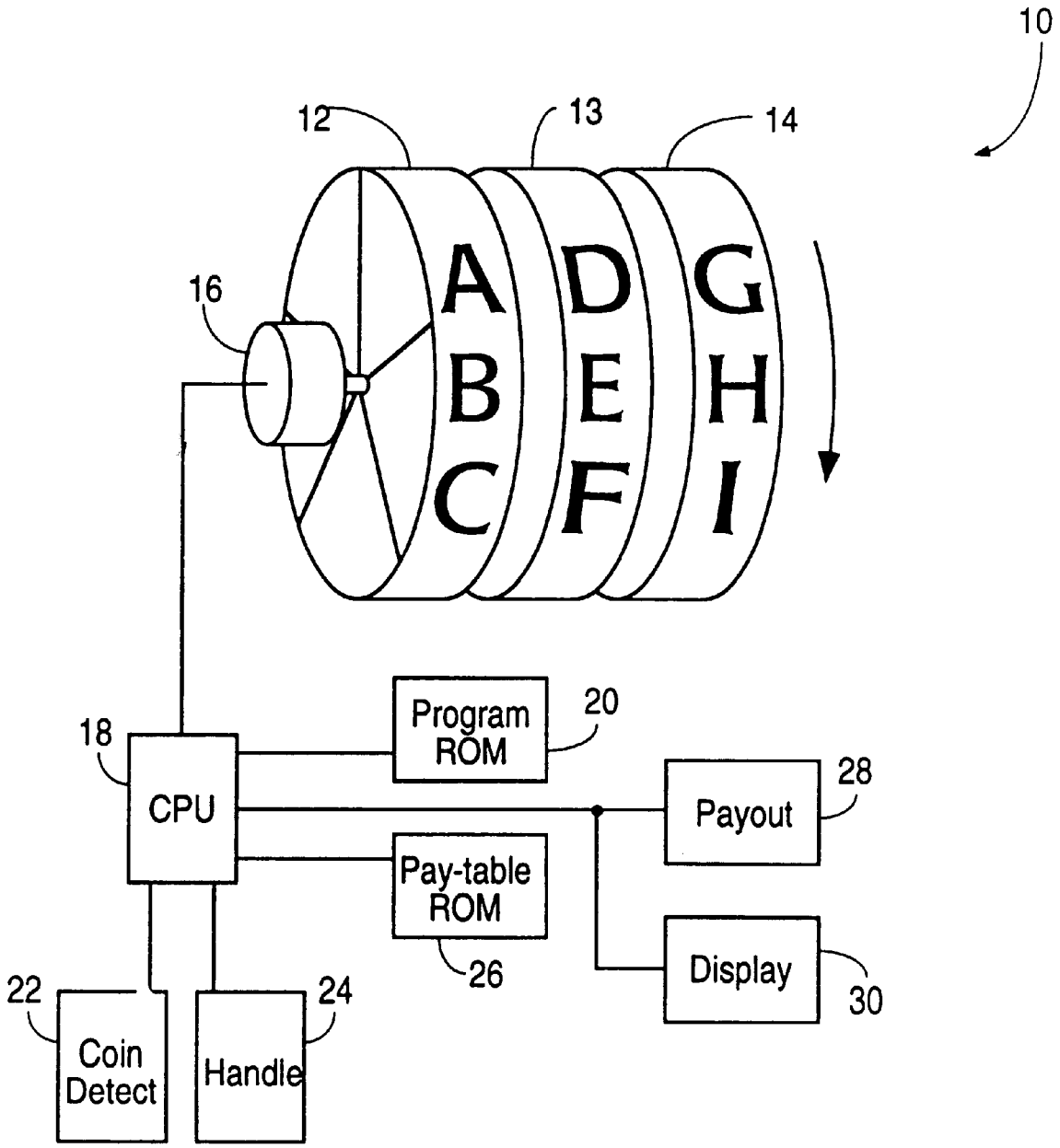
FIG. 1 (PRIOR ART)
FIG. 1 illustrates well-known circuitry for operating a slot machine.

The slot machine of FIG. 2 performs the same functions as the conventional slot machine of FIG. 1 but has an additional feature. This feature will be referred to as a symbol save feature, which allows a player to save any displayed symbol for use in a subsequent game. Symbols may be saved manually by pressing a button, or, alternatively, the machine may automatically save special symbols for the player's use in later games. A description of the invention will be presented with reference to FIG. 2, the front view of a slot machine in FIG. 3, and the flowchart of the slot machine operation in FIG. 4.

In step 1, a coin is deposited through slot 32 (FIG. 3) and is detected by a coin detector 22 (FIG. 2). A paper currency slot and reader may also be incorporated in the slot machine of FIG. 3. The detection of the coin and the pulling of handle 24, or the pressing of button 34, initiates a next game, as indicated in step 2 of FIG. 4.

Figure 4:
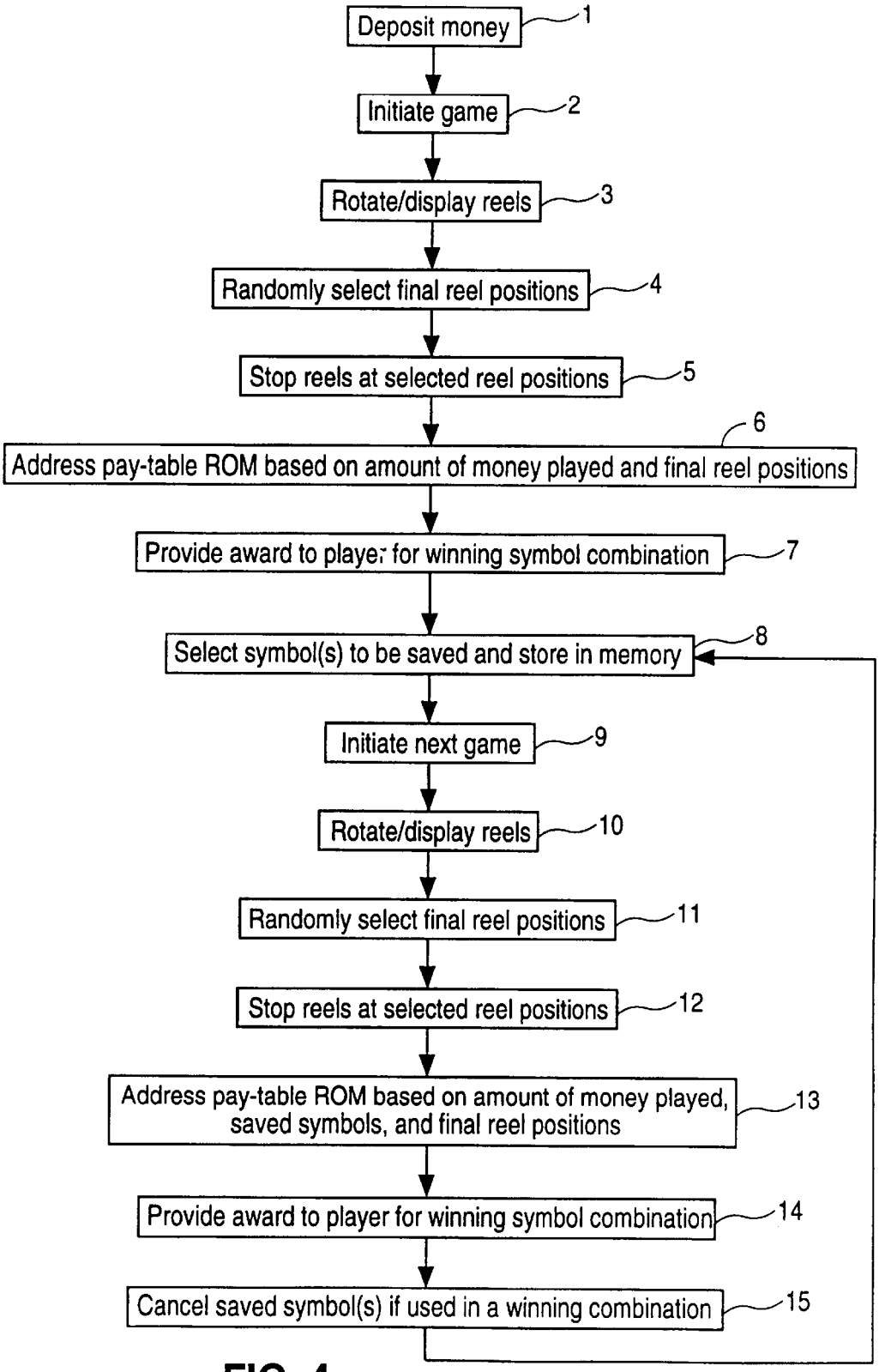
FIG. 4 is a flow diagram illustrating the basic steps carried out by the slot machine in accordance with the present invention.

A CPU 36 (FIG. 2), under control of a program ROM 38, rotates the reels 12–14 by issuing pulses to stepper motors 16, as indicated by step 3 in FIG. 4. In step 4, a random number generator in the program ROM 38 selects the final reel positions for reels 12–14. CPU 36 issues the required number of pulses to stepper motors 16 in order to cause the reels 12–14 to reach their final positions. The positions of the reels 12–14 may be determined by either counting the number of pulses to each stepper motor 16 or by counting pulses generated by a photo-optical element which detects tabs around the periphery of each of reels 12–14. Such methods of selecting a final reel postion and stopping the reels at the selected reel positions are well known and commonly used in the art. In step 5, the reels are stopped at their selected positions.

Figure 3:
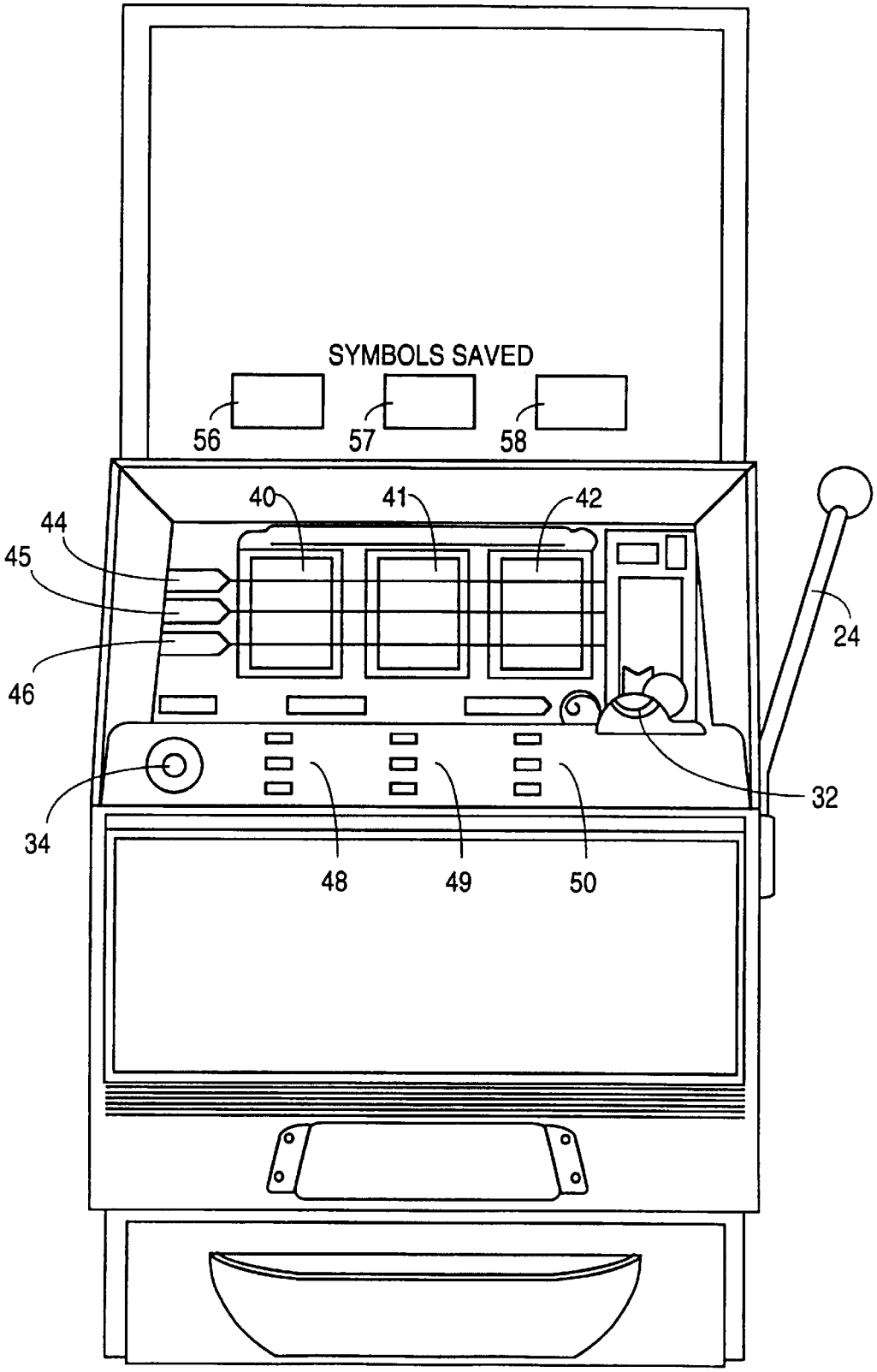
FIG. 3 is a front view of a slot machine incorporating the present invention.

The reels are displayed through display windows 40, 41, and 42 in FIG. 3. A slot machine incorporating this invention may include more than 3 reels. In the particular embodiment shown in FIG. 3, three consecutive symbols on each of reels 12–14 are displayed through the display windows 40–42. A symbol may be any image and may even be a blank. Three paylines 44, 45 and 46 are printed on the display glass of the slot machine to identify the paylines which are applicable for a particular play. Typically, the deposit of one coin will activate the center payline 45, and additional coins will activate the paylines 44 and 46. A winning combination of symbols appearing across any activated payline will result in a win for that player.

In step 6 of FIG. 4, a pay-table ROM 48 (FIG. 2) is addressed with an address based upon the number of coins played and the final reel positions. For example, if three coins were played, a winning combination across any of the three paylines 44–46 would be acknowledged by the pay-table ROM 48 as a win. The pay-table ROM 48 provides a signal to CPU 36 to control a payout mechanism 28 to provide the number of coins or credits to the player corresponding to the winning symbol combination, as shown in step 7 of FIG. 4.

The operation of the preferred slot machine, thus far, has been that of a conventional slot machine. The present invention can also be used in slot machines which have only a single payline or which use a CRT or other flat screen display to represent the rotation of reels rather than provide actual mechanical reels.

After the reels have stopped, the player may elect to save one or more symbols displayed for each reel position. This may be accomplished by pressing one or more buttons 48, 49, and 50 (FIG. 3) associated with each reel. In one embodiment of a slot machine having three paylines, there are three buttons per reel to select a symbol on any one of the paylines. Hence, up to three symbols per reel may be saved. In another embodiment, only one symbol per reel can be saved.

In another embodiment, only special symbols may be designated by the machine as the symbols applicable to the symbol save feature. In such an embodiment, the machine itself may automatically save these special symbols are they appear in the display windows 40–42.

The manual saving of symbols by buttons 48–50 or the automatic saving of symbols is indicated by the symbol save controller 52 in FIG. 2 and indicated by step 8 in FIG. 4.

The saved symbols are stored in a symbol save memory 54 (FIG. 2), and the save symbols are displayed to the user in display areas 56, 57 and 58 in FIG. 3. In one embodiment, an image of the saved symbol(s) is illuminated in areas 56–58 in FIG. 3. Any arrangement of a display for displaying the saved symbols to the player may be used, and such a display is designated as display 60 in FIG. 2.

In the preferred embodiment, any symbol from a reel which is saved by the player or the machine only applies to that same reel position in subsequent games. Thus, the saved symbol originally displayed in display window 40 will appear in display area 56 and can only be later used in combination with symbols displayed in windows 41 and 42 or with symbols saved in display areas 52 and 58. In another embodiment, the origin of the saved symbol is not relevant, and the saved symbol(s) can be used with any reel combination.

The player may then deposit more coins and initiate a next game, as shown in step 9 of FIG. 4. The step of saving symbols, instead of being conducted before additional coins or credits are wagered, may be conducted after additional coins or credits are wagered but before the initiation of the next game. Again, the reels are rotated, the final reel positions are randomly selected, and the reels are stopped, as shown in steps 10, 11, and 12, respectively, in FIG. 4.

A winning combination of symbols may now be determined by using the currently displayed symbols by the reels 12–14 and the saved symbols from one or more previous games. The pay-table ROM 48 is then provided an address which may be based upon, for example, the number of coins played, the saved symbols, and the symbols displayed by the reels to determine whether there is a winning combination of symbols and to determine the award to be played to the player, as shown in step 13 of FIG. 4. Other criteria for addressing the pay-table ROM 48 or other circuitry for providing an award to the player may also be used.

The output of the pay-table ROM 48 is provided to CPU 36, which then controls the payout mechanism 28 to provide the corresponding award to the player for the winning symbol combination, as shown in step 14 of FIG. 4, and the display of the saved symbols is extinguished.

If a winning combination used any of the saved symbols, the saved symbols are canceled, as shown in step 15 of FIG. 4, and the display of the saved symbols is ceased.

The player may now select additional symbols to save and store in the symbol save memory 54, as illustrated by the return path in FIG. 4.

Any method and means of indicating symbols to be saved and applying the saved symbols to a subsequent game are envisioned by the invention. For example, separate buttons may be provided for saving particular symbols and then selecting which symbols in a subsequent game to replace with the saved symbols.

Figure 5:
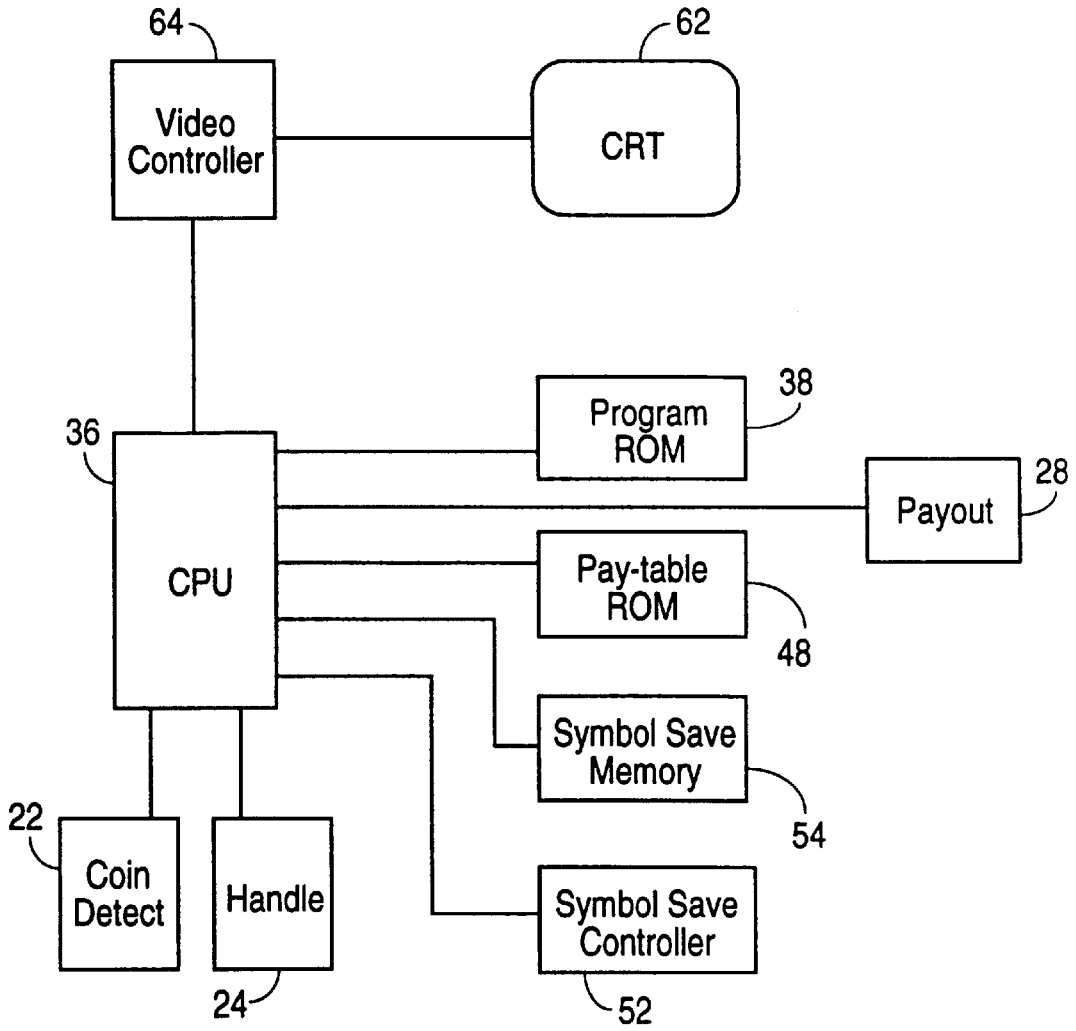
FIG. 5 illustrates circuitry similar to FIG. 2, but modified for controlling a video slot machine displaying rotating reels.

FIG. 5 illustrates the circuitry used in a video slot machine which displays an animated version of rotating reels on a CRT 62. A video controller 64 controls CRT 62 and receives commands from CPU 36. One skilled in the art would understand the requirements for video controller 64 and CPU 36, since these devices would be generic to a wide variety of video slot machines. In a video slot machine, a separate display to identify the saved symbols is not required since the saved symbols would be displayed on CRT 62.

One skilled in the art could easily modify conventional slot machine programs stored in a program ROM to incorporate the symbol save feature of this invention. One skilled in the art could also easily modify the conventional program in a pay-table ROM to take into account the symbols saved in memory 54 when determining whether a winning combination exists. The symbol save controller 52 may easily be implemented by determining the displayed symbol corresponding to buttons 48–50, since the final positions of the reels are already known by CPU 36. Accordingly, one skilled in the art may implement numerous embodiments of this invention without further technical description.

Figure 6:
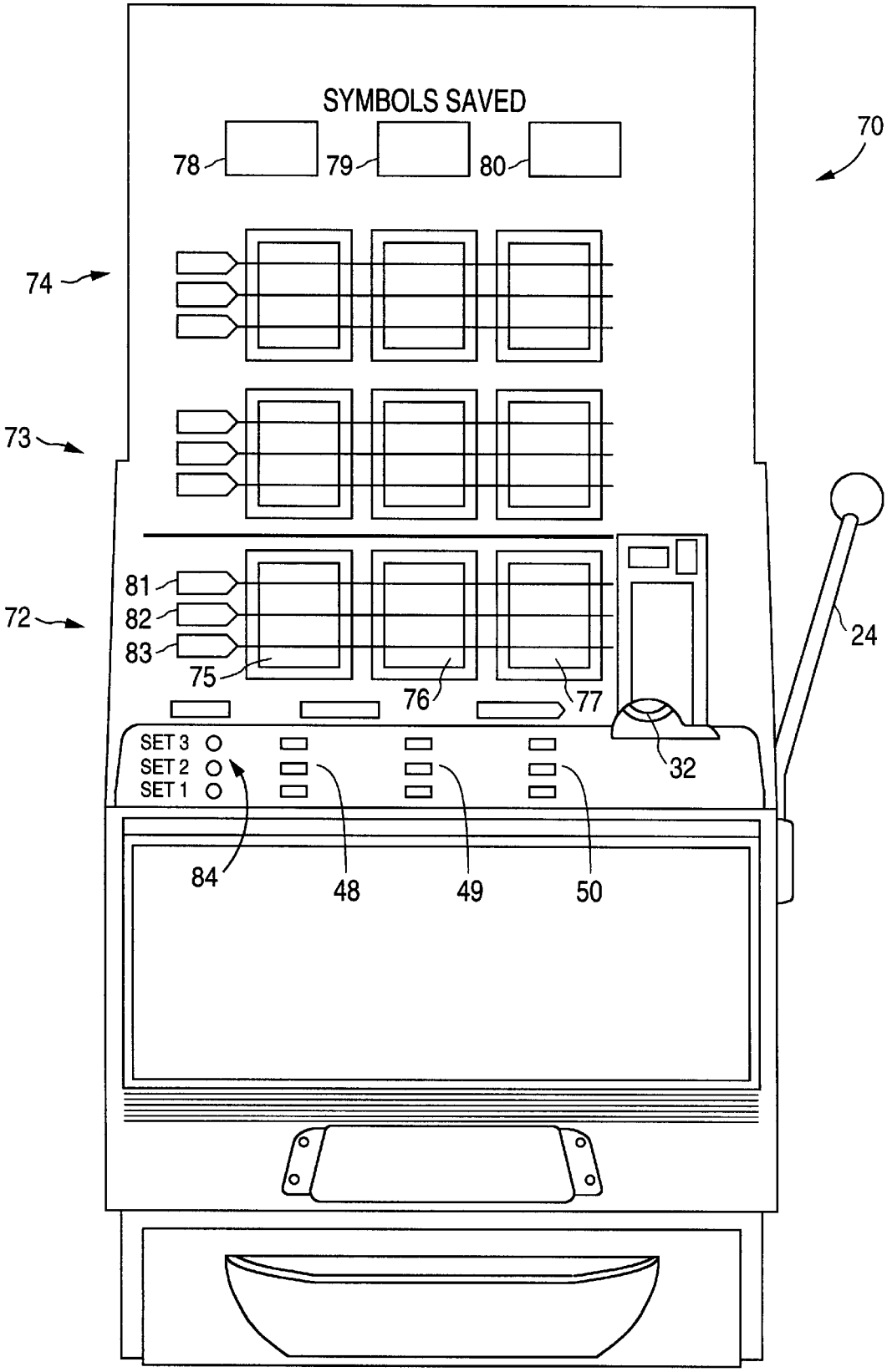
FIG. 6 is a front view of a machine incorporating an embodiment of the invention using three sets of reels.

Another embodiment of the invention is illustrated in FIG. 6. Elements labeled with the same numbers as in FIG. 3 may be identical. The slot machine 70 incorporates multiple sets of reels along with the symbol save feature. Machine 70 uses three sets of reels 72, 73, 74, but the number of sets of reels may be four, five, six, or more. Also, shown in FIG. 6, each set of reels has three reels 75, 76, 77; however, there may be four, five, six, or more reels per set. Also, the embodiment shown in FIG. 6 uses three paylines per reel; however, other embodiments of the invention use a single payline per reel set. As in the embodiment of FIG. 3, saved symbols are available for use in subsequent games until used in a symbol combination.

The invention of FIG. 6 allows the player to save any symbol from the primary set of reels 72 to be subsequently used in either the next game or any subsequent game for any of the sets of reels 72, 73, 74. The saved symbols are stored in memory and displayed in windows 78, 79 and 80. Windows 78, 79 and 80 correspond to reels 75, 76, and 77, respectively.

Buttons 48, 49 and 50, as in FIG. 3, select the particular symbol to be saved from an associated reel in the primary set of reels 72, and the saved symbols are displayed in the windows 78, 79, and 80. In one embodiment, if three coins are inserted in slot 32, activating all three paylines 81, 82, 83, then three symbols may be saved from each of the primary reels and displayed in the associated windows 78–80. If only one coin is inserted, only the center payline 82 is activated, and only symbols on the center payline may be saved.

Once the symbols are saved and the handle 24 is pulled to initiate a subsequent game, the saved symbols are applied to the respective reels in any of the reel sets to achieve the highest paying combination. Not all saved symbols need be used in any one particular game.

In another embodiment, the player is given the opportunity to decide whether to apply the saved symbols to a particular reel by pressing any of the buttons 84, each identifying a particular set of reels 72, 73, 74. Buttons 48–50 may then be used to replace a particular symbol on an associated reel with a saved symbol.

The game algorithm is similar to that described with respect to FIG. 4 except that the saved symbols are obtained from the primary set of reels 72 and may be applied to either the secondary sets of reels 73, 74 or, additionally, applied to the primary set of reels 72. This provides additional chances to the player to win.

The invention of FIG. 6 can generate a higher revenue than prior art machines since the player can be required to insert additional coins to bring into play the secondary set of reels. For example, the player may be required to deposit three coins to activate the three paylines of the primary set of reels 72 and activate the symbol save feature for only the primary set of reels 72. With six coins deposited, the player may additionally activate the three paylines of one of the secondary sets of reels 73. Additional coins can be used to activate additional paylines and additional reel sets to provide the maximum chance of winning.

In another embodiment, symbols from any of the reel sets 72, 73, and 74 may be saved, and additional symbol save windows may be added. In such an embodiment, any combination of the saved symbols may be applied to any of the sets of reels to greatly increase the chances of a winning combination.

Figure 7:
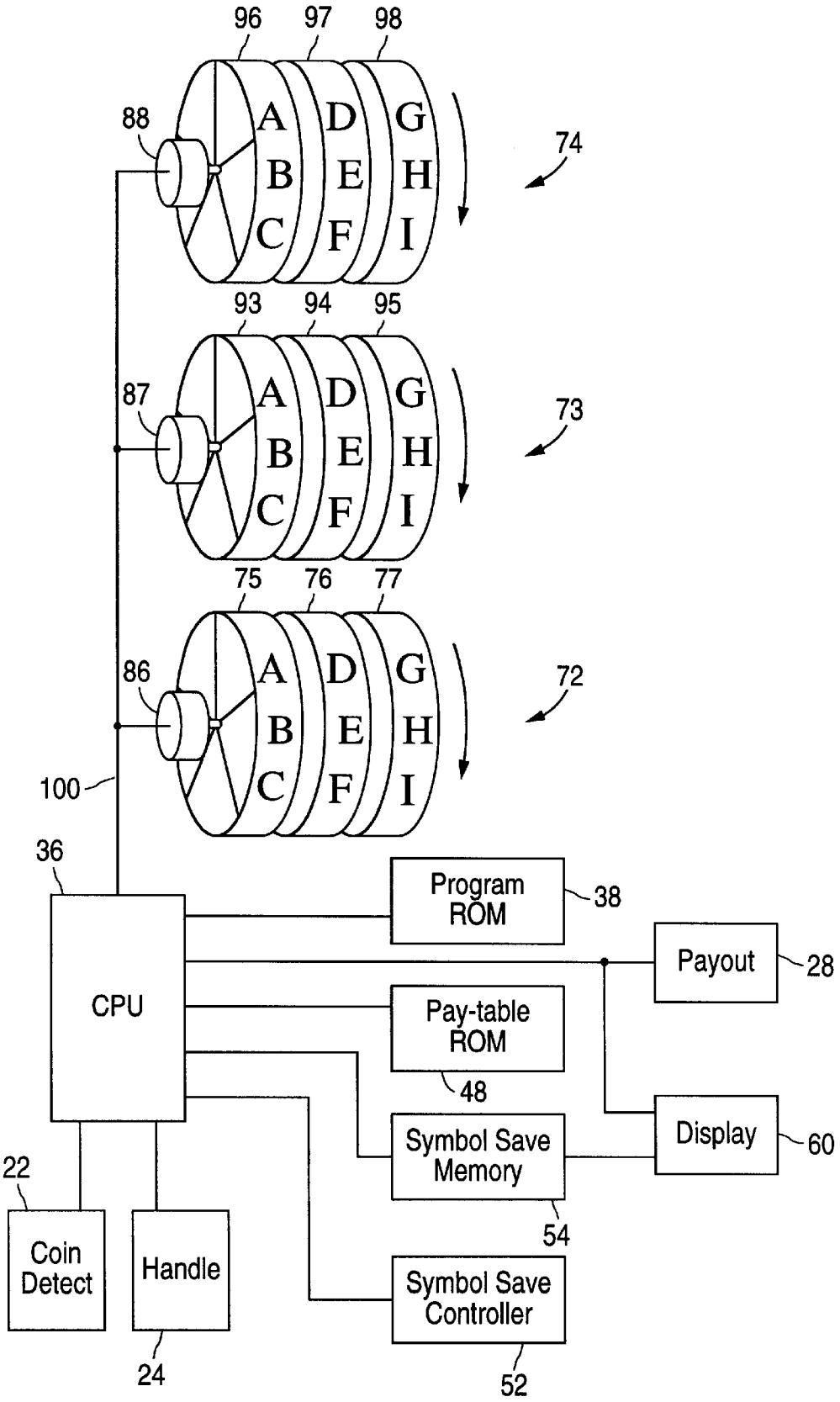
FIG. 7 is a functional diagram of the machine of FIG. 6.

FIG. 7 illustrates the internal circuitry within the machine 70 which, in one embodiment, includes stepper motors 86, 87, and 88 (other stepper motors not shown) for each of the reels 75–77 and 93–98 in each of the reel sets.

Cable 100 illustrates a plurality of wires connected to the stepper motors to controllably start and stop each of the reels to display a particular symbol. The remainder of the circuitry is virtually identical to that described with respect to FIG. 2. The program ROM 38 includes instructions to carry out the program previously described with respect to FIG. 6, and the pay-table ROM 48 is programmed to provide suitable awards for the various possibilities of winning yet still provide the machine 70 owner with a profit over the long term.

Figure 8:
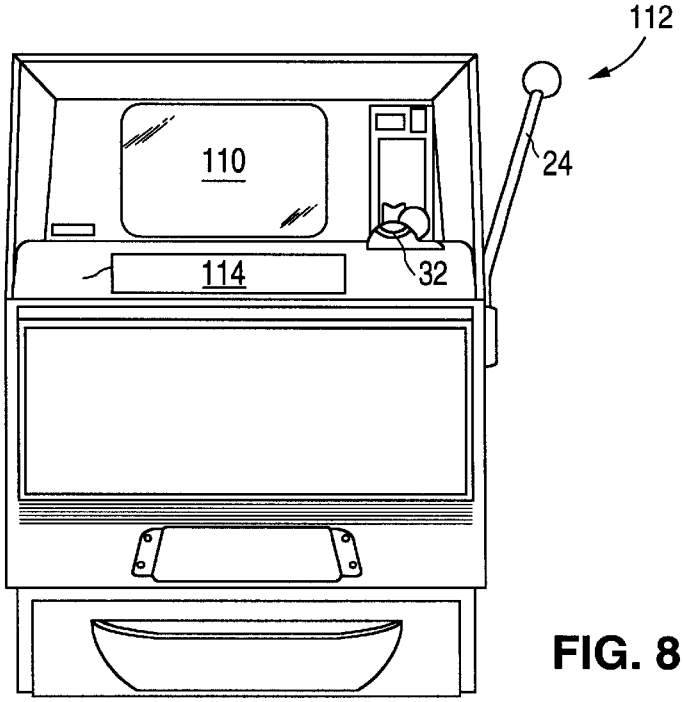
FIG. 8 is a video version of the machine of FIG. 6 or any other machine described herein.

The rotating reels need not be physical reels but may be displayed on a video screen, such as on screen 110 in the slot machine 112 shown in FIG. 8. The control panel 114 contains the various buttons and other controls necessary for initiating the game, selecting the saved symbols, and applying the saved symbols to the particular reels. Alternatively, the control may be by touching screen 110 in appropriate places. The screen 110 may also display the saved symbols. The term rotating reels may also apply to reels whose symbols are flashed on the screen to convey rotating reels Elements labeled with the same numerals in the various drawings may be identical to one another. The internal structure of the video slot machine 112 may be similar to that shown in FIG. 5.

In an alternate embodiment, symbols saved by a player result in the corresponding reel not spinning for the next game or any subsequent game unless the reel (whether physical or video) is released by the player by pressing a button or the saved symbol is used in an award payout. Subsequent games use the saved symbol. In such embodiments, a separate display area for the saved symbol is not needed. This concept may be used in single or multiple reel sets embodiments.

In another embodiment, the symbols on the periphery of the reels, whether video or physical reels, include certain special symbols, such as a wild card or a winning symbol (e.g., a cherry resulting in an automatic win) that is automatically saved without player intervention. In such a case, step 8 in FIG. 4 is performed automatically by the machine by detecting that the special symbol is one of the symbols in the final combination of displayed symbols. The saving by the machine may either be by storing the saved symbol in a memory and displaying that symbol in a separate display area or by preventing the reel (either physical or video) from spinning in a subsequent game until used.

In another version of a slot machine with a symbol save feature that does not require player intervention to save a symbol, winning symbols or other special symbols displayed by the primary set of reels cause the corresponding reel in a second or third set of reels (see FIG. 7) to stop on that same winning symbol. This process is described more fully in the flowchart of FIG. 9.

Figure 9:
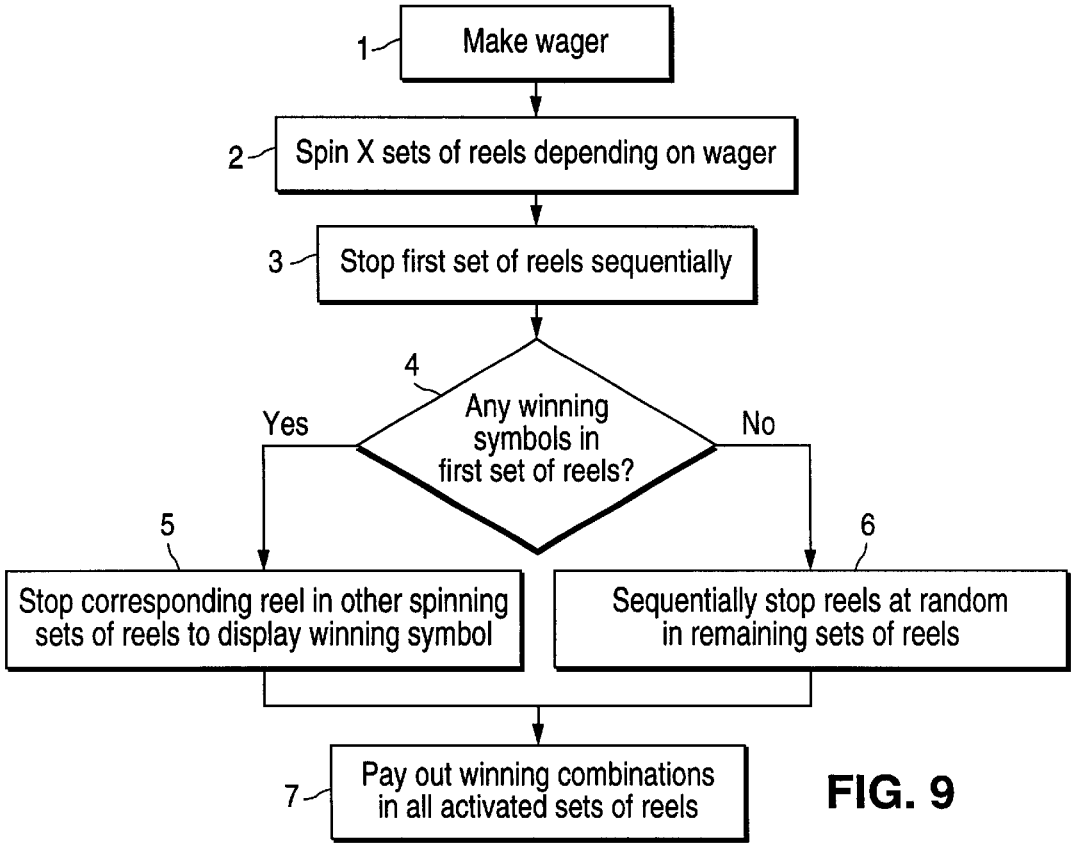
FIG. 9 is a flowchart of a method performed by a machine, such as that in FIG. 7, where special symbols displayed by a primary set of reels cause corresponding reels in secondary sets of reels to stop on the same special symbol.

In step 1 of FIG. 9, the player makes a wager in a gaming machine having multiple sets of reels, such as that illustrated in FIG. 7 or in the video version of FIG. 8. By depositing additional wagers, the player activates additional sets of reels. For purposes of this example, it will be assumed that there are three sets of reels, although this invention may be implemented with two sets of reels or more than three sets of reels.

In step 2 of FIG. 9, the reel sets activated by the wager (assume three reel sets activated) are caused to spin by the associated stepper motors.

In step 3, the reels in the primary set of reels 72 (FIG. 7) stop sequentially, typically from left to right. For each reel that has stopped, a determination is made in step 4 of FIG. 9 whether that symbol is a winning symbol, or other predetermined symbol having value. One example of such a symbol is a cherry, which is an automatic winner. Assuming the leftmost reel of the primary set of reels stops on a cherry, the process proceeds to step 5, which causes the leftmost reel in the secondary set of reels 73 to stop on a cherry. As understood by those skilled in the art, the symbols displayed by the various reels are controlled by CPU 36 in FIG. 7; the CPU may control the number of pulses provided to the stepper motors after a zero position to obtain the desired symbol or detect codes around the periphery of the reels. Thus, a winning symbol (i.e., a cherry) is displayed by the leftmost reel in both the primary set of reels 72 and the secondary set of reels 73. In one embodiment, the leftmost reel in a third set of reels 74 is also stopped on a cherry.

As the reels of the primary set of reels 72 sequentially stop, any special symbols displayed on these reels then cause the corresponding reels in the other sets of reels to stop at that symbol, thereby at least duplicating the winning symbols. If the symbols displayed in the primary set of reels 72 are not special symbols, such as winning symbols, then the reels in the additional sets of reels 73 and 74 are stopped sequentially at random positions (step 6).

When all the reels have stopped spinning, the player is then paid out the winnings for the symbol combinations in the three sets of reels (step 7).

Figure 10:
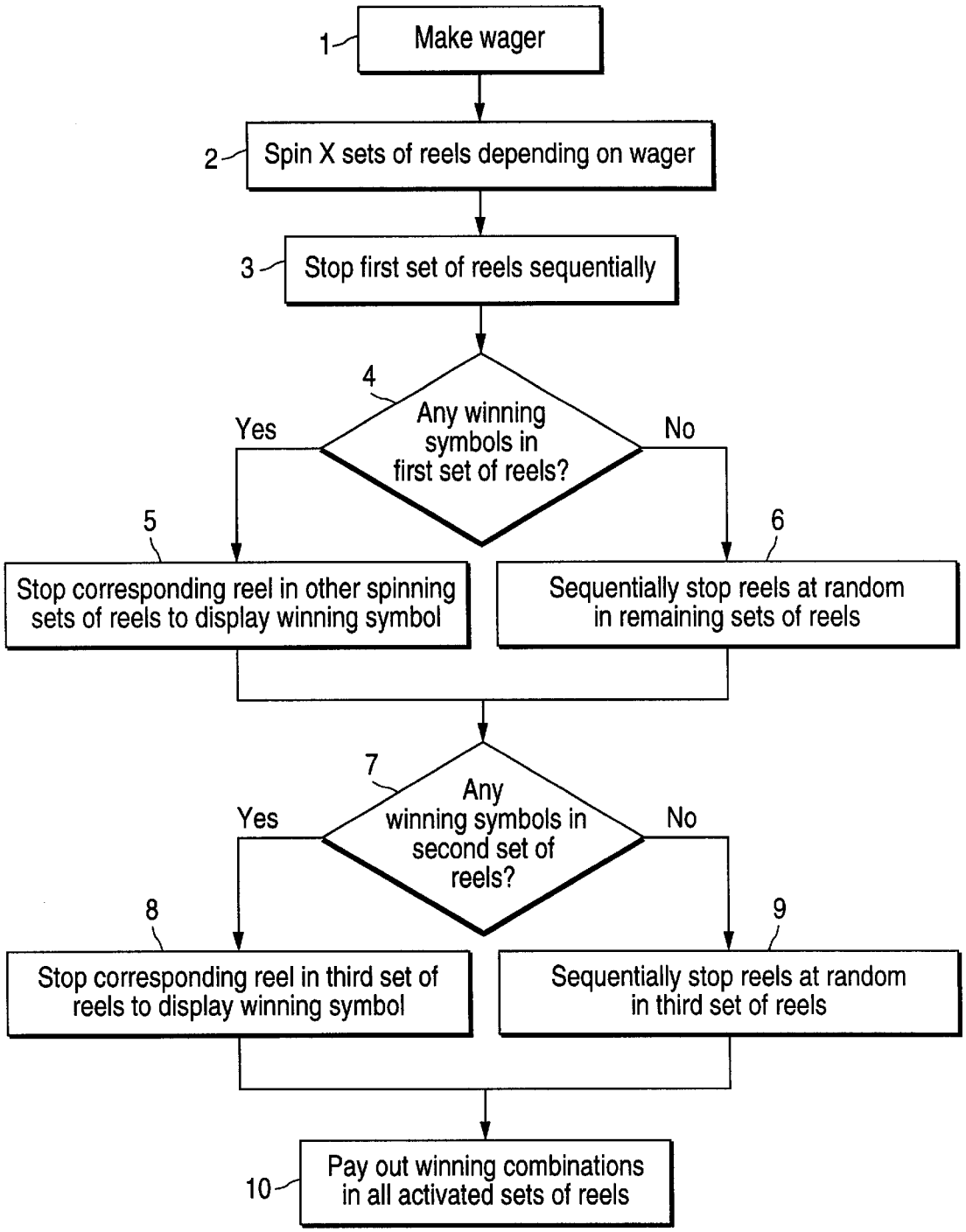
FIG. 10 is a flowchart of an alternate embodiment method using multiple sets of reels.

The process of FIG. 9 may be modified in various ways to attract players' interests. For example, one variation is illustrated in FIG. 10 which has the same steps 1–6 as FIG. 9 but includes the additional feature of causing any winning symbols obtained in the second set of reels 73 (FIG. 7) to also be displayed in the third set of reels 74. More specifically, in step 7 of FIG. 10, a determination is made whether any of the symbols displayed by the second set of reels 73 is a winning symbol, such as a cherry. If yes, the process proceeds to step 8, which causes the corresponding reel in the third set of reels 74 to stop on that winning symbol, thus guaranteeing a win in both the second and third sets of reels.

Conversely, if no winning symbol is displayed in the second set of reels 73, the reels in the third set of reels 74 are sequentially stopped randomly (step 9).

In step 10, all the reels have stopped and the player is paid for the winning combinations of symbols in the three sets of reels.

The concepts described with respect to FIGS. 9 and 10 apply to any predetermined symbols that are believed valuable enough to be duplicated in other sets of reels. Using these techniques, the player is motivated to make an additional wager to activate multiple sets of reels since the chances of winning are greatly enhanced. Additional wagers may also be multipliers of any award, as well as providing the player more chances to win.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A slot machine comprising:

a display portion displaying a plurality of rotatable reels, each reel having a plurality of symbols on its periphery;

a controller for rotating said reels and stopping said reels such that at least one symbol on each reel is displayed to a player of the slot machine across at least one payline;

a selector for allowing said player to store at least one displayed symbol per reel as one or more saved symbols in a memory for use in a subsequent game, said selector being available for use by said player to store said at least one displayed symbol after each game, stored symbols being available for use by said player for a plurality of subsequent games;

a display area associated with each of said rotatable reels for displaying said one or more saved symbols of said respective reel; and an award table for awarding a payment to said player for winning combinations of symbols using both said one or more saved symbols and currently displayed symbols for determining a winning combination of symbols.

2. The slot machine of claim 1 wherein said display portion comprises said rotatable reels rotated by a motor.

3. The slot machine of claim 1 wherein said display portion comprises an electronic display for displaying said rotatable reels on a display screen.

4. The slot machine of claim 1 wherein said selector comprises a plurality of actuators associated with each of said rotatable reels, wherein activating one of said plurality of actuators stores a displayed symbol on an associated reel as a saved symbol in said memory for use in a subsequent game.

5. The slot machine of claim 1 wherein said selector comprises a different selector for each of said rotatable reels.

6. The slot machine of claim 1 wherein said rotatable reels comprise a first reel, a second reel, and a third reel, said selector comprising a different selector for each of said rotatable reels, wherein activating a selector for one of said rotatable reels causes a displayed symbol on said one of said rotatable reels to be saved for use in combination only with symbols displayed by the remaining rotatable reels.

7. The slot machine of claim 1 wherein said rotatable reels comprise a first reel, a second reel, and a third reel, said selector comprising a different selector for each of said rotatable reels, wherein activating a selector for one of said rotatable reels causes a displayed symbol on said one of said rotatable reels to be saved for use in combination with displayed symbols on any of said rotatable reels.

8. The slot machine of claim 1 further comprising a circuit for canceling one or more of said saved symbols in said memory after a payment to said player has been made for a winning combination utilizing one or more of said saved symbols.

9. The slot machine of claim 1 wherein said display portion displays multiple sets of reels.

10. The slot machine of claim 9 wherein said multiple sets of reels comprises a primary set of reels and at least one secondary set of reels, wherein said selector allows said player to store at least one displayed symbol per reel in said primary set of reels as one or more saved symbols in said memory for use in a subsequent game, wherein said one or more saved symbols being available for use by said player to replace symbols displayed by at least said secondary set of reels.

11. The slot machine of claim 10 wherein said stored symbols are available for use by said player for replacing symbols on reels within said primary set of reels and symbols within said secondary sets of reels.

12. The slot machine of claim 1 wherein said selector automatically applies said saved symbols to replace symbols displayed in a subsequent game.

13. The slot machine of claim 1 wherein said selector allows said player to select which displayed symbols are to be substituted by said saved symbols.

14. The slot machine of claim 1 wherein said selector comprises one set of actuators for identifying saved symbols and another set of actuators for applying said saved symbols in a subsequent game.

15. A method for operating a slot machine comprising the steps of:

displaying rotating reels in said slot machine, each reel having a plurality of symbols around its periphery;

stopping said reels to display at least one symbol on each reel in a particular symbol combination;

selecting one or more displayed symbols for at least one of said reels to be saved and stored in a memory, said machine allowing a player to perform said step of selecting after each game, stored symbols being available for use by said player for a plurality of subsequent games;

displaying said saved symbols in a display area associated with the respective reel;

displaying rotating each of said reels subsequent to said step of selecting;

stopping said reels to display at least one symbol on each reel in another particular symbol combination; and determining a payment to a player for a winning combination of symbols using both saved symbols and currently displayed symbols for determining a winning combination of symbols.

16. The method of claim 15 wherein said step of selecting comprises touching an actuator associated with each of said reels to save a symbol displayed by an associated reel.

17. The method of claim 15 wherein symbols saved during said step of selecting are used in combination with any other symbols displayed by said reels for determining a winning combination of symbols.

18. The method of claim 15 wherein symbols saved during said step of selecting are used in combination only with symbols on reels other than the reel associated with the saved symbol, for determining a winning combination of symbols.

19. The method of claim 15 further comprising the step of canceling one or more saved symbols once it has been determined that a winning combination of symbols uses said one or more saved symbols in combination with one or more currently displayed symbols on said reels.

20. The method of claim 15 wherein said displaying rotating reels comprises displaying said rotating reels on a video screen.

21. The method of claim 15 wherein said displaying rotating reels comprises displaying physical rotating reels through a display window.

22. A slot machine comprising:

a display portion displaying a plurality of sets of rotatable reels, said plurality of sets comprising at least a first set and a second set, each reel in said first set and said second set having a plurality of symbols on its periphery;

a controller for rotating said reels and stopping said reels such that at least one symbol on each reel is displayed to a player of the slot machine across at least one payline;

a selector for allowing said player to store at least one displayed symbol per reel in at least said first set of reels as one or more saved symbols in a memory for use in a subsequent game, said selector being available for use by said player to store said at least one displayed symbol after a game wherein said stored symbols are available for use by said player for a plurality of subsequent games;

a display area associated with at least each of said rotatable reels in said first set for displaying said one or more saved symbols of said respective reel; and an award table for awarding a payment to said player for winning combinations of symbols using both said one or more saved symbols and currently displayed symbols for determining a winning combination of symbols.

23. The slot machine of claim 22 further comprising a monetary detection unit which allows said player to utilize saved symbols for additional sets of reels upon additional payment.

24. The slot machine of claim 22 wherein said selector allows said player to store at least one displayed symbol per reel only from said first set of reels as one or more saved symbols in a memory for use in a subsequent game.

25. The slot machine of claim 24 wherein said one or more saved symbols are available for use by said player for substituting symbols in at least said second set of reels.

26. The slot machine of claim 22 further comprising a monetary detection unit which allows said player to utilize said saved symbols for additional reel positions upon additional payment.

27. A method for operating a slot machine comprising the steps of:

displaying a plurality of sets of rotating reels in said slot machine, each reel having a plurality of symbols around its periphery, said plurality of sets comprising a first set and a second set;

stopping said reels to display at least one symbol on each reel in a particular symbol combination;

selecting one or more displayed symbols for at least one of said reels in at least said first set to be saved and stored in a memory, said machine allowing a player to perform said step of selecting after each game, stored symbols being available for use by said player for a plurality of subsequent games;

displaying said saved symbols in a display area associated with the respective reel;

displaying rotating each of said reels subsequent to said step of selecting;

stopping said reels to display at least one symbol on each reel in another particular symbol combination; and determining a payment to a player for a winning combination of symbols using both saved symbols and currently displayed symbols for determining a winning combination of symbols.

28. A slot machine comprising:

a display portion displaying a plurality of rotatable reels, each reel having a plurality of symbols on its periphery;

a controller for rotating said reels and stopping said reels in a first game such that at least one symbol on each reel is displayed to a player of the slot machine across at least one payline, said controller preventing rotation of any reel in a next game if said any reel displayed any special symbol in said first game; and an award table for awarding a payment to said player for winning combinations of symbols using said special symbol from said first game and symbols obtained by spinning and stopping remaining reels in said next game.

29. The slot machine of claim 28 wherein said display portion comprises said rotatable reels rotated by a motor.

30. The slot machine of claim 28 wherein said display portion comprises an electronic display for displaying said rotatable reels on a display screen.

31. The slot machine of claim 28 wherein said special symbol includes a winning symbol.

32. A method for operating a slot machine comprising the steps of:

displaying rotating reels in said slot machine, each reel having a plurality of symbols around its periphery;

stopping said reels in a first game to display at least one symbol on each reel in a particular symbol combination;

preventing rotation of any reel in a next game if said any reel displayed any special symbol in said first game; and determining a payment to a player for a winning combination of symbols using said special symbol from said first game and symbols obtained by spinning and stopping remaining reels in said next game.

33. The method of claim 32 wherein said special symbol includes a winning symbol.

34. A slot machine comprising:

a display portion displaying a plurality of sets of rotatable reels, said plurality of sets comprising at least a first set and a second set, each reel in said first set and said second set having a plurality of symbols on its periphery; and a controller for rotating said reels in said first set and said second set and stopping said reels in said first set such that at least one symbol on each reel in said first set is displayed to a player of the slot machine across at least one payline, said controller detecting whether any special symbol has been displayed by any reel in said first set of reels and, in response, stopping corresponding reel(s) in said second set of reels to display said special symbol.

35. The slot machine at claim 34 further comprising:

an award table for awarding a payment to said player for winning combinations of symbols in both said first set of reels and said second set of reels.

36. The slot machine of claim 34 further comprising a third set of reels and wherein said controller detects whether any special symbol has been displayed by said first set of reels and, in response, stops corresponding reels in said second and said third sets of reels to display said special symbol.

37. The slot machine of claim 34 further comprising a third set of reels and wherein said controller detects whether any special symbol has been displayed by said second set of reels and, in response, stops corresponding reels in said third set of reels to display said special symbol.

38. The slot machine of claim 34 wherein said special symbol includes a winning symbol.

39. The slot machine of claim 34 further comprising a monetary bet detector, said detector signalling to said controller to activate said first set of reels upon a first bet amount and activate said second set of reels upon an additional bet amount.

40. A method for operating a slot machine comprising the steps of:

displaying a plurality of sets of rotating reels in said slot machine, each reel having a plurality of symbols around its periphery, said plurality of sets comprising a first set and a second set;

rotating said reels in said first set and said second set;

stopping said reels in said first set to display at least one symbol on each reel in said first set; and detecting whether any special symbol has been displayed by any reel in said first set of reels and, in response, stopping corresponding reel(s) in said second set of reels to display said special symbol.

41. The method of claim 40 further comprising:

determining a payment to a player for a winning combination of symbols in both said first set of reels and said second set of reels.

42. The method of claim 40 wherein said plurality of sets further comprises a third set of reels, said method further comprising detecting whether any special symbol has been displayed by said first set of reels and, in response, stopping corresponding reels in said second and said third sets of reels to display said special symbol.

43. The method of claim 42 further comprising detecting whether any special symbol has been displayed by said second set of reels and, in response, stopping corresponding reels in said third set of reels to display said special symbol.

44. The method of claim 40 wherein said special symbol includes a winning symbol.

45. The method of claim 40 further comprising detecting a monetary bet and activating said first set of reels upon a first bet amount and activating said second set of reels upon an additional bet amount.

* * * * *